United States Patent [19]

Vockinger

[11] Patent Number: 4,470,750

[45] Date of Patent: Sep. 11, 1984

[54] CONVEYING APPARATUS

[75] Inventor: Johann Vockinger, Moosburg, Fed. Rep. of Germany

[73] Assignee: Steinbock GmbH

[21] Appl. No.: 408,888

[22] Filed: Aug. 17, 1982

[30] Foreign Application Priority Data

Oct. 16, 1981 [DE] Fed. Rep. of Germany ..... 3141215

[51] Int. Cl.[3] ..... B66F 9/14

[52] U.S. Cl. ..... 414/666; 414/667

[58] Field of Search ..... 414/222, 622, 662–671, 414/282, 283

[56] References Cited

U.S. PATENT DOCUMENTS

| | | | |
|---|---|---|---|
| 2,910,204 | 10/1959 | Wight | 414/666 |
| 3,025,986 | 3/1962 | Arnold et al. | 414/667 |
| 3,106,305 | 10/1963 | Gehring | 414/666 |
| 3,848,759 | 11/1974 | Goodacre et al. | 414/666 |
| 3,937,346 | 2/1976 | van der Laan | 414/666 |

FOREIGN PATENT DOCUMENTS

| | | |
|---|---|---|
| 2322566 | 11/1973 | Fed. Rep. of Germany . |
| 7909972 | 8/1980 | Fed. Rep. of Germany . |

OTHER PUBLICATIONS

Pamphlet, "Elektro-Dreiseitenstapler Depotlift", Undated.

*Primary Examiner*—Joseph E. Valenza

*Assistant Examiner*—David A. Bucci

*Attorney, Agent, or Firm*—Toren, McGeady and Stanger

[57] ABSTRACT

A load-conveying apparatus provided with a load support device, a jib arm having the load support device mounted thereon and adapted to be swiveled relative thereto about a vertical axis, a guide frame having the jib arm extending therefrom in a cantilevered fashion, the guide frame supporting the jib arm for lateral movement along the guide frame in a generally horizontal direction, drive means for driving the jib arm along the guide frame, and stabilizing means for absorbing turning moments applied about a vertical axis acting between the jib arm and the guide frame. In accordance with the present invention, the stabilizing means include a moment-absorbing carriage having a length extending in the direction of lateral movement of the jib arm on the guide frame and being laterally movable on the guide frame in the lateral direction, movement limiters for limiting the range of movement of the moment-absorbing carriage on the guide frame between two opposed locations, and a sliding member having the jib arm mounted thereon and being displaceable along the moment-absorbing carriage to effect displacement of the jib arm relative to the moment-absorbing carriage, the sliding member having a length which is smaller than the length of the moment-absorbing carriage so as to enable sliding movement thereof together with the jib arm along the moment-absorbing carriage.

7 Claims, 5 Drawing Figures

CONVEYING APPARATUS

The present invention relates generally to load-conveying devices and more particularly to a shelf-conveying device having a lateral thrust device.

Devices to which the present invention relates usually comprise a guide frame arranged to extend transversely to a main driving direction of the conveying device and a jib arm which is movable along the guide frame in a horizontal direction through drive means for effecting lateral movement. The jib arm carries the load-receiving means which may, for example, be a fork lift device which is adapted to swivel about a vertical axis relative to the jib arm.

Conveying devices of the type described are known from German Utility Model No. 79 09 972.

In known conveying devices, two pairs of guide rollers are arranged spaced apart in the direction of lateral movement which operate to effect stabilization of the jib arm relative to the guide frame in the event that there occur moments of force acting about the vertical axis on the respective members. Each of the guide rollers is housed between two guide faces of the guide frame extending in the lateral direction of movement. Through the utilization of such pairings of guide rollers which are spaced apart in each instance in the direction of lateral movement, travel of the jib arm is limited to a given length relative to the guide frame in the direction of lateral movement.

In an arrangement known from German Offenlegungsschrift No. 23 22 566 there is provided means for effecting stabilization of the jib arm relative to the guide frame during the occurrence of moments around a vertical axis. Such stabilization means comprise two toothed racks or rods extending in the direction of lateral movement parallel to each other and arranged behind each other in the main driving direction on respective guide positions on the guide frame. Two toothed pinions are provided on the jib arm between the two toothed racks and the toothed pinions mesh with each other as well as with one of the toothed racks, respectively. It would be possible in principle to lengthen the extent of movement of the jib arm relative to the guide frame in the direction of lateral movement to a given length of the guide frame. This lengthening, however, must be accomplished at the expense of the structural length of the device taken in the main driving direction. That is, the lateral thrust device must not only be lengthened in the main driving direction, but beyond this, the entire device must be overdimensioned because of the load lever arm which is thereby enlarged. A further disadvantage is the enlarged space requirements which would result from extending the total length of the conveying device including the side thrust device.

A side thrust device is known from a pamphlet entitled "Elektro-Dreiseitenstapler Depotlift" (Electro-Three-sided Lifter Depotlift) of the firm Steinbock GmbH wherein the jib arm is guided on the guide frame by means of a slide bush of the jib arm. The slide bush slides on a guide rod of the guide frame, and the slide bush must be formed with a considerable length since it must absorb almost all of the moments occurring between the jib arm and the guide frame. Thus, with this known solution, the problem of lengthening the path of travel of the jib arm to a given length of the guide frame cannot be solved and additionally the sliding friction occurring over the entire length of the guide frame raises considerable problems.

Thus, the present invention is directed toward providing a conveying device which is structured in such a way that at a given length of the guide frame taken in the direction of lateral movement, the length of travel of the jib arm can be extended.

SUMMARY OF THE INVENTION

Briefly, the present invention may be described as a load-conveying apparatus comprising: load-supporting means; a jib arm having said load-supporting means mounted thereon for swiveling movement relative thereto about a vertical axis; a guide frame having said jib arm extending therefrom and supporting said jib arm for lateral movement along the guide frame in a generally horizontal direction; drive means for driving the jib arm along the guide frame; and stabilizing means for absorbing turning moments applied about a vertical axis acting between the jib arm and the guide frame, the stabilizing means comprising a moment-absorbing carriage having a length extending in the direction of lateral movement of the jib arm on the guide frame and being laterally movable on the guide frame in the lateral direction, means for limiting the range of movement of the moment-absorbing carriage on the guide frame between two opposed locations, and a sliding member having the jib arm mounted thereon and being displaceable along the moment-absorbing carriage to effect displacement of the jib arm relative to the moment-absorbing carriage. The sliding member is formed with a length which is smaller than the length of the moment-absorbing carriage and as a result, sliding movement of the sliding member together with the jib arm along the moment-absorbing carriage is possible. Thus, after the moment-absorbing carriage has reached either end of its limited range of movement, the sliding member having the jib arm mounted thereon may be further moved relative to the moment-absorbing carriage thereby extending the range of movement of the jib arm.

As a result of the arrangement of the present invention, the jib arm is capable of moving to the extreme positions on the ends of the guide frame, and such movement is not impeded despite the fact that the moment-absorbing carriage has reached its limit of movement. This is achieved due to the fact that despite the movement limiters applied to terminate movement of the moment-absorbing carriage, the jib arm is nevertheless further capable of movement relative to the moment-absorbing carriage and thus has its range of motion extended.

In the structure in accordance with the present invention, the moment-absorbing carriage may be guided on two vertical guide faces with at least two guide rollers or guide roller pairs with vertical axes which are spaced apart in the direction of lateral movement. The spacing of these guide rollers from one another in the lateral direction of movement is not critical for the travel of the jib arm at a given length of the guide frame and can therefore be dimensioned so as to be sufficiently large that in a relatively light construction the occurring moments may be transmitted from the jib arm to the guide frame. The guidance with the guide roller pairs is preferred because such a guidance can be formed in a manner free of play.

The length of the sliding member in the lateral direction of movement may be shortened even more if the sliding member only has to undertake the function of stabilizing the jib arm relative to the guide frame. For this reason, in accordance with a preferred embodiment of the invention, for the transmission of weight and possible pitching or tilting moments of the jib arm around an axis extending in the lateral direction of movement, at least one additional guide arrangement between the jib arm and the guide frame is provided.

In principle, different types of lateral drive means may be employed. Of course, an embodiment wherein the lateral drive means comprise at least one lateral drive toothed wheel supported on the jib arm and driven by a lateral movement motor attached to the jib arm is preferred. This lateral drive toothed wheel meshes with a toothed rack on the guide frame extending in the direction of lateral movement. In this embodiment, there is also made a contribution to the lengthening of the degree of travel of the jib arm to a given length on the guide frame. Additionally, two lateral drive toothed wheels having vertical axes running in synchronization and spaced apart vertically can each mesh with a toothed rack in order, in this way, to achieve stabilization of the jib arm about an axis parallel to the main driving direction.

In the arrangement in accordance with the invention, the jib arm, the slide member, guide members for the jib arm which may include one or several additional guide arrangements, and the lateral drive toothed wheel or wheels may be arranged so as to be located to occupy a vertically extending space which has a disc-like configuration extending in the main driving direction and having minimal dimensions in the lateral direction of movement, once again taking into consideration the lengthening of the degree of travel of the jib arm at the given length of the guide frame in the lateral direction of movement.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there illustrated and described a preferred embodiment of the invention.

DETAILED DESCRIPTION OF THE PREFERRED EMBODIMENT

Figure 1:
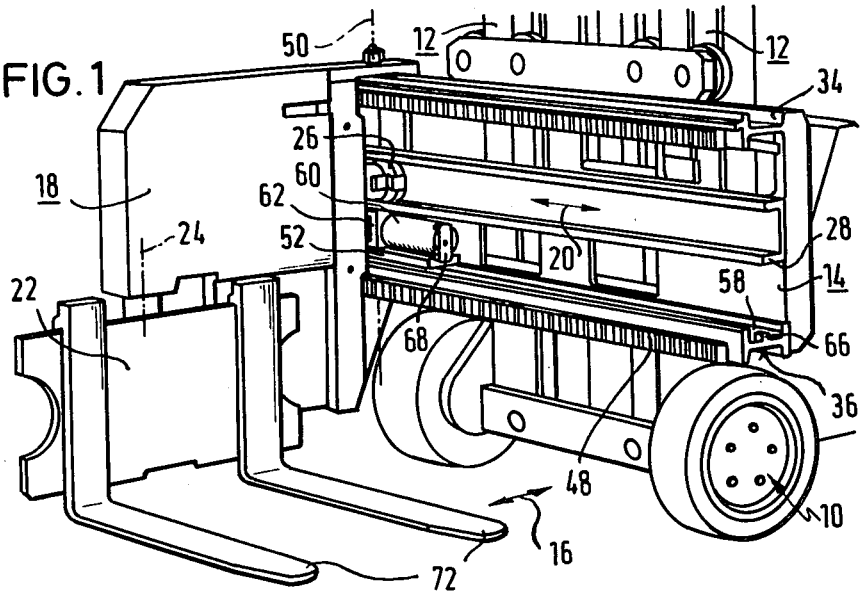
FIG. 1 is a perspective view showing a conveying device in accordance with the present invention.
Figure 2:
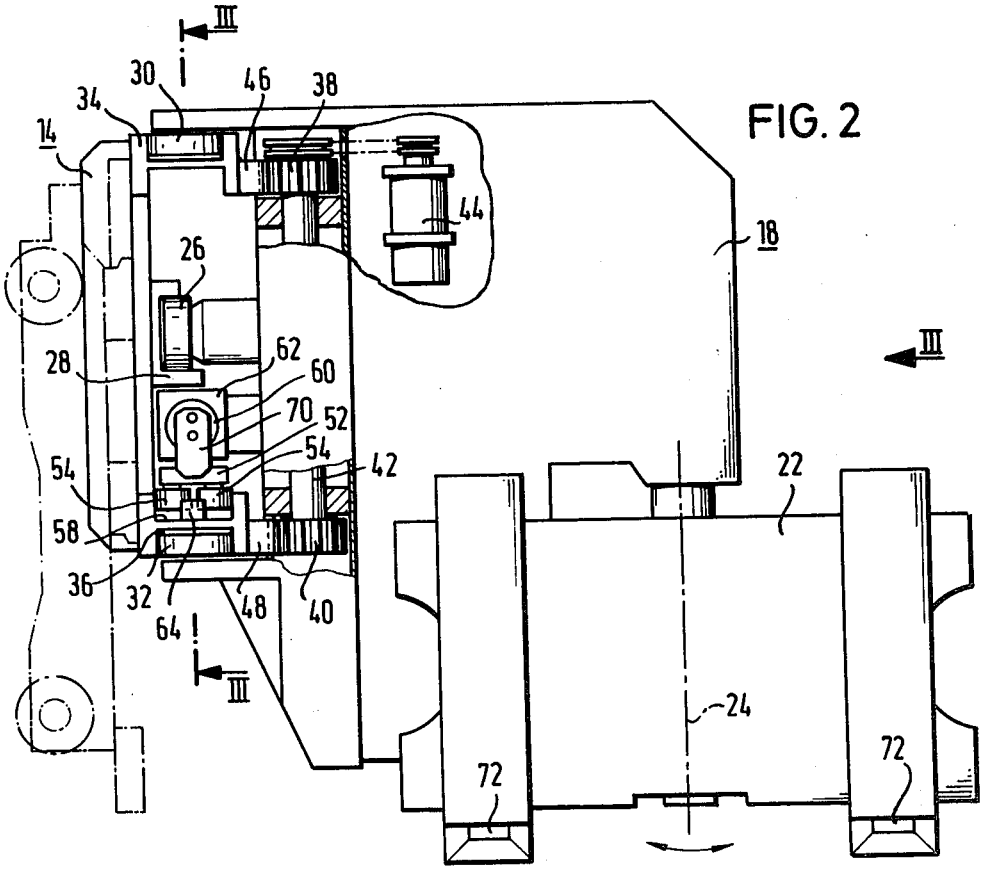
FIG. 2 is a side view of the conveying device as seen in the lateral direction of movement, with parts broken away.

Referring now to the drawings wherein like reference numerals are used to identify similar parts in the various figures thereof, the apparatus of the invention is shown in its overall configuration in FIG. 1 which depicts a conveying device generally designated in its entirety by the numeral 10. The conveying device is, for example, a shelf conveyor operating as a motorized vehicle and having a lift mast 12 arranged on the motorized vehicle. A guide frame 14 is arranged so as to be movably adjustable to different heights on the lift mast 12 by means of a drive mechanism (not shown). The driving direction of the conveying device is designated by the arrow 16.

A jib arm 18 is mounted for guided movement on the guide frame 14, the direction of movement of the jib arm 18 being horizontal lateral movement in the direction of the arrows 20. A fork lift carrier 22 is supported on the jib arm 18 in a manner enabling it to be swiveled around a vertical swiveling axis 24. The fork lift carrier 22 is connected with a hydraulic motor (not shown) housed within the jib arm 18 for driving the fork lift 22 for swiveling movement about the axis 24.

A weight transmission roller 26 is supported on the jib arm 18 to enable the weight of the jib arm 18 to be supported by the guide frame 14. The weight transmission roller 26 engages in a first U-shaped guideway 28. Two pitching or tilting moment-absorbing rollers 30 and 32 are attached on the guide frame 14 for transmission of pitching or tilting moments which may act about an axis parallel to the movement direction 20 between the jib arm 18 and the guide frame 14. The tilting moment-absorbing rollers 30 and 32 engage in two additional U-shaped guideways 34 and 36 which extend parallel to the lateral direction of movement 20. Moreover, two toothed lateral drive wheels 38 and 40 are supported on the jib arm 18 so as to be rotatable about a vertical axis. The toothed lateral drive wheels 38 and 40 are connected to be nonrotatable relative to each other by means of a synchronization shaft 42, and the wheels 38 and 40 are arranged to be driven by a lateral drive motor 44. The lateral drive motor 44 may be a hydraulic motor which is driven by pressure from a pressurized supply means of the apparatus.

The toothed lateral drive wheels 38 and 40 are in engagement with two toothed racks 46 and 48 which extend parallel to the lateral direction of movement 20, and the toothed racks 46 and 48 are fastened on the guide frame 14. As a result of the synchronized rotation of the lateral drive wheels 38 and 40 provided by the synchronization shaft 42, pitching or tilting moments of the jib arm 18 relative to the guide frame 14 about a tilting axis extending parallel to the driving direction 16 will be absorbed.

For the absorption of moments which may occur between the jib arm 18 and the guide frame 14 around a vertical axis 50 at the respective guided positions, a moment-absorbing carriage 52 is arranged for guided movement on the guide frame 14 by means of two roller pairs 54 and 56 which are arranged one behind the other in the direction of lateral movement 20 and which engage in an additional U-shaped guideway 58. A guide rod 60 which extends in the direction of lateral movement 20 is arranged on the moment-absorbing carriage 52. This guide rod 60 is enclosed in a slide bush 62 which is firmly connected with the jib arm 18. The length of the slide bush 62 in the direction of lateral movement 20 is shorter than the length of the moment-absorbing carriage 52 and approximately corresponds to the width of the jib arm 18 which is dimensioned in accordance with minimum requirements for reasons of construction and solidity. The moment-absorbing carriage 52 is movable along the length of the guide frame 14 in the direction of lateral movement 20 between a pair of movement limiters 64 and 66.

During movement of the jib arm 18 in the direction 20, substantial moments of force occur around the axis 50 when the jib arm is accelerated or slowed in its movement. When the jib arm 18 moves from the position depicted in FIG. 4 in the direction of the position depicted in FIG. 5, i.e., in the direction 20 along the frame 14, the moment-absorbing carriage 50 is carried along toward the left, as viewed in FIGS. 4 and 5, as a result of the friction occurring between the slide bush 62 and the guide rod 60. The rolling friction of the moment-absorbing carriage 52 over the roller pairs 54, 56 in the U-shaped guideway 58 is comparatively small. Once the moment-absorbing carriage 52 runs against the movement limiter 64, sliding movement of the slide bush 62 on the guide rod 60 occurs and this movement continues until the slide bush 62 runs against a holding device 70 of the guide rod 60, as shown in FIG. 5.

When the greatest moment of force around the axis 50 occurs during contact of the slide bush 62 with the holding device 70, the slide bush 62 has already come to a standstill so that large moments occur only in the stationary position. For this reason, stabilization of the moments occurring around the axis 50, as shown, will be fully sufficient and for this reason the slide bush 62 may also have a short construction.

Figure 4:
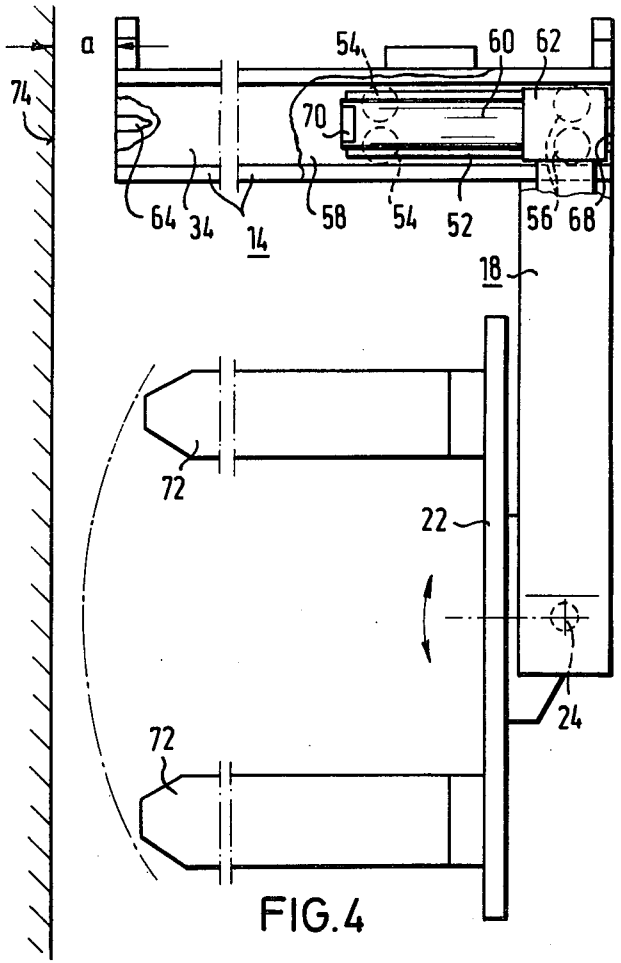
FIG. 4 is a top view seen in the direction of the arrow IV of FIG. 3.
Figure 3:
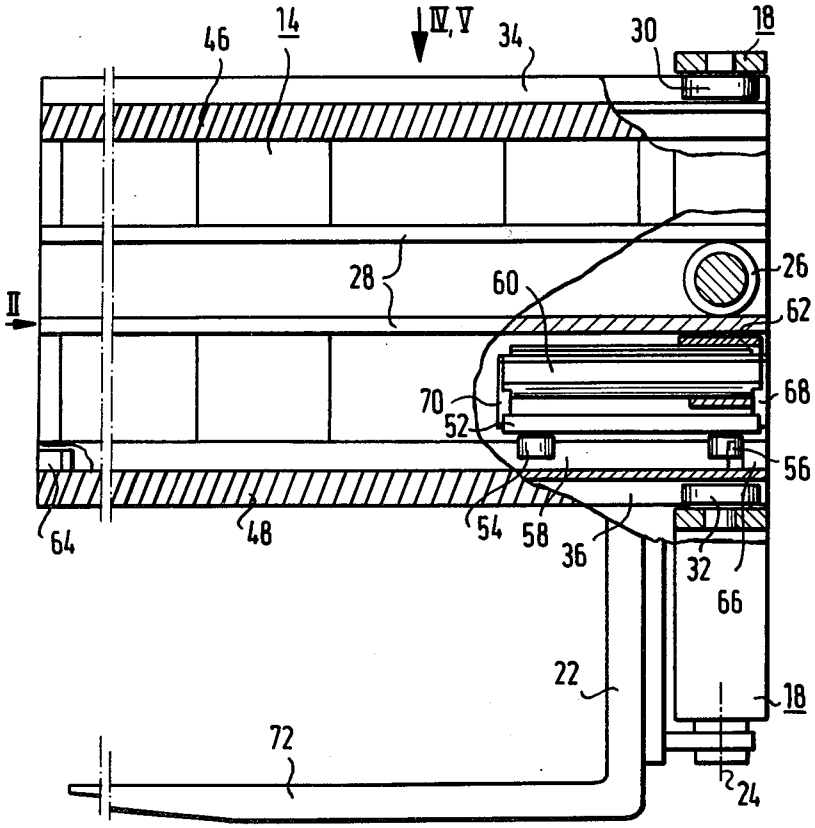
FIG. 3 is a partial sectional view taken in the direction of the arrow III in FIG. 2 and along the line III—III of FIG. 2.
Figure 5:
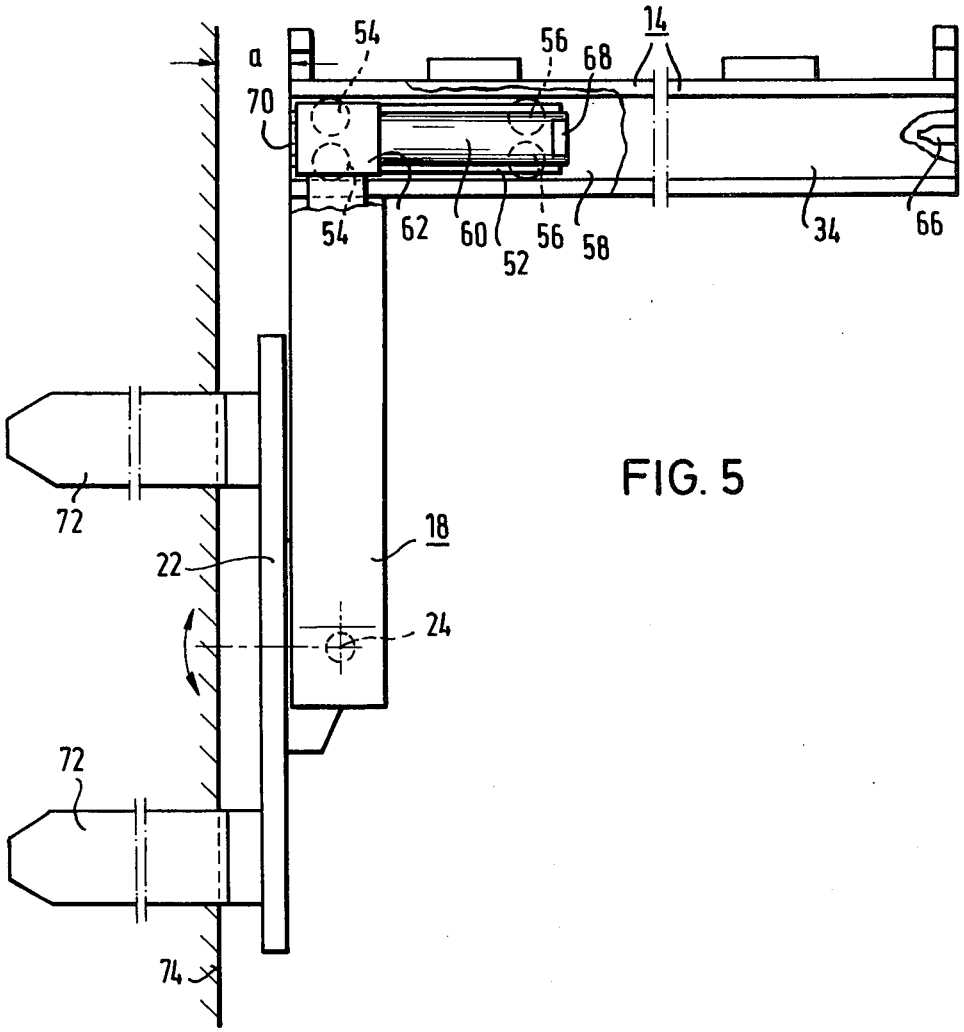
FIG. 5 is likewise a top view seen in the direction of the arrow V of FIG. 3 showing the device in another position.

It may be clearly seen from FIGS. 4 and 5 that the jib arm is capable of movement to both ends of the guide frame 14 directly without hindrance along the length of the moment-absorbing carriage 52, which length is greater than the length of the slide bush 62.

As can be seen from FIG. 5, the fork lift carrier 22 may be moved up to the end of the guide frame 14 with the jib arm 18 so that the forks of the carrier 22 can be inserted to extend a substantial portion of their distance along an adjacent shelf 74 with a given safety distance a being provided between the left end of the guide frame 14 and the shelf 74. Thus, a relatively large safety distance a may be selected as desired in order to prevent the device from driving into the shelf itself or into, for example, projecting parts of the shelf.

As can be seen from FIG. 4, the swiveling point 24 of the fork lift carrier 22 can be moved toward the right end of the guide frame 14 so that the distance between the shelf 74 and the left ends of the forks 72 is sufficient to permit swiveling of the forks 72 around the swivel axis 24 within the passage between two shelf walls. If the jib arm 18 were not capable of movement a sufficient distance to the right as seen in FIG. 4, a lengthening of the guide frame 14 could nevertheless be considered in order to retain the turning capacity. However, this would lead to a lessening of the safety margin a so that in order to enable the device to retain the safety margin, the width of the passage between the shelf walls would have to be widened in turn, which would lead to an undesired waste of space.

The problems discussed arise in particular if the fork lift carrier 22 may be swiveled 180° around the swivel axis 24 relative the jib arm 18.

Thus, it will be seen from FIGS. 4 and 5 that when the jib arm 18 is to be moved from the rightmost position in FIG. 4 to the leftmost position in FIG. 5, the carriage 52 is first moved from the movement limiter 66 into engagement with the movement limiter 64. After the movement of the carriage 52 has stopped, the slide bush 62 and the jib arm 18 may be further moved by sliding motion of the slide bush 62 along the carriage 52 whereby the range of movement of the jib arm 18 can be extended. Of course, a reverse operation occurs when the carriage 52 and the jib arm 18 are moved in the opposite direction.

Thus, it will be seen that the conveying device of the invention provided with a lateral thrust device operates to stabilize the jib arm relative to the guide frame 14 during the occurrence of moments of force around the vertical axis 50. The moment-absorbing carriage 52 is guided on the guide frame 14 so as to roll between the two movement limiters 64 and 66 on the ends of the guide frame, and the jib arm 18 is displaceable on the slide guide member of the moment-absorbing carriage relative to the latter by means of slide bush 62 which is formed with a length that is smaller taken relative to the length of the moment-absorbing carriage 52. The sliding member of the invention is comprised of the slide bush 62 and the slide guide member 60 which is a guiding rod.

The moment-absorbing carriage 52 is guided on two vertical guide faces 58 by means of at least two guide rollers 54, 56 or two guide roller pairs which have a vertical axis and are spaced apart in the lateral direction of movement.

In addition to the moment-absorbing carriage 52, at least one additional guiding arrangement is provided which comprises the elements 26, 28, 30, 32, 34, and 36 and this additional guiding arrangement is provided between the jib arm 18 and the guide frame 14 in order to provide for the transmission and support of the weight of the jib arm 18 and possible pitching or tilting moments thereof around an axis extending in the lateral direction of movement 20.

The lateral movement drive means of the invention comprises at least one toothed lateral drive wheel 38 and 40 supported on the jib arm 18 and driven by the lateral drive motor 44 attached on the jib arm 18, with the toothed lateral drive wheels 38 and 40 meshing with a toothed rack 46, 48 extending in the lateral direction of movement 20 on the guide frame 14.

The two vertically spaced apart toothed lateral drive wheels 38 and 40 operate in rotational synchronization as a result of the synchronization shaft 42 and each mesh with one of the toothed racks 46 and 48.

It will be seen that the jib arm 18, the slide member 62, the guide members 26, 30, and 32 of the additional guide arrangement, and the toothed lateral drive wheels 38 and 40 are arranged or housed within a vertical space having a disc-like configuration with a minimal dimension in the direction of the lateral direction of movement 20 and extending in the main driving direction 16.

While a specific embodiment of the invention has been shown and described in detail to illustrate the application of the inventive principles, it will be understood that the invention may be embodied otherwise without departing from such principles.

What is claimed is:

1. A load-conveying apparatus comprising:

load supporting means;

a jib arm having said load supporting means mounted thereon for swiveling movement relative thereto about a vertical axis;

a guide frame having said jib arm extending therefrom and supporting said jib arm for lateral movement along said guide frame in a generally horizontal direction;

drive means for driving said jib arm along said guide frame; and stabilizing means for absorbing turning moments applied about a vertical axis acting between said jib arm and said guide frame, said stabilizing means comprising a moment-absorbing carriage having a length extending in the direction of lateral movement of said jib arm on said guide frame and being laterally movable on said guide frame in said lateral direction, means for limiting the range of movement of said moment-absorbing carriage on said guide frame between two opposed locations, and a sliding member having said jib arm mounted thereon and being displaceable along said moment-absorbing carriage to effect displacement of said jib arm relative to said moment-absorbing carriage, said sliding member having a length which is smaller than the length of said moment-absorbing carriage so as to enable sliding movement thereof together with said jib arm along said moment-absorbing carriage.

2. Apparatus according to claim 1 wherein said sliding member comprises a slide bush and a slide guide member in the form of a guide rod.

3. Apparatus according to claim 1 wherein said moment-absorbing carriage is arranged for guided movement on said guide frame on two vertical guide faces by means of at least two guide rollers having vertical axes and spaced apart in the lateral direction of movement.

4. Apparatus according to claim 1 further comprising additional guide means provided between said jib arm and said guide frame to enable support of the weight of said jib arm and pitching or tilting moments occurring on said jib arm around an axis extending parallel to said direction of lateral movement.

5. Apparatus according to claim 4 wherein said lateral drive means comprise toothed lateral drive wheel means supported on said jib arm, lateral drive motor means driving said lateral drive wheel means, and toothed rack means extending the direction of said lateral movement on said guide frame and meshing with said toothed lateral drive wheel means.

6. Apparatus according to claim 5 wherein said toothed lateral drive wheel means comprise a pair of vertically spaced apart toothed lateral drive wheels which operate in synchronization with each other, said toothed rack means comprising a pair of toothed racks meshing respectively with one each of said toothed wheels.

7. Apparatus according to claim 6 wherein said jib arm, said sliding member, parts of said additional guide means, and said toothed lateral drive wheels are arranged within a vertically extending space having a generally disc-like configuration with a minimal dimension taken in the direction of said lateral movement and extending in the driving direction of said apparatus.

* * * * *